United States Patent [19]

Hannen

[11] Patent Number: 4,651,508

[45] Date of Patent: Mar. 24, 1987

[54] SHRINK-WRAPPING APPARATUS, ESPECIALLY FOR STACKED ARTICLES

[75] Inventor: Reiner W. Hannen, Goch, Fed. Rep. of Germany

[73] Assignee: MSK-Verpackungs-Systeme Gesellschaft MIT Beschrankter Haftung, Kleve, Fed. Rep. of Germany

[21] Appl. No.: 852,301

[22] Filed: Apr. 15, 1986

[30] Foreign Application Priority Data

May 10, 1985 [DE] Fed. Rep. of Germany ..... 8513892

[51] Int. Cl.[4] ..... B65B 53/06

[52] U.S. Cl. ..... 53/557; 53/567; 53/442

[58] Field of Search ..... 53/442, 557, 567

[56] References Cited

U.S. PATENT DOCUMENTS 3,930,790 1/1976 Rogosch ..... 53/557

FOREIGN PATENT DOCUMENTS 88424 9/1983 European Pat. Off. ..... 53/557

WO82/03833 11/1982 PCT Int'l Appl. ..... 53/557

*Primary Examiner*—John Sipos

*Attorney, Agent, or Firm*—Karl F. Ross; Herbert Dubno

[57] ABSTRACT

An apparatus for packaging a stack of goods by shrinking a shrinkable foil covering on it comprises a delivery mechanism for drawing a foil tubing from a roll of tubing which cuts away a piece from the foil tubing and closes the top of that piece by an end weld seam, and a framelike vertically movable shrinking mechanism which heats all sides of the piece covering the stack of goods. To avoid a premature shrinking of the shrinkable foil covering or the foil tubing a nozzle device for making an air curtain extending substantially horizontally is provided under the delivery mechanism but above the range of travel of the shrinking mechanism and a blower for providing the air flow for the air curtain is connected with the nozzle device.

6 Claims, 1 Drawing Figure

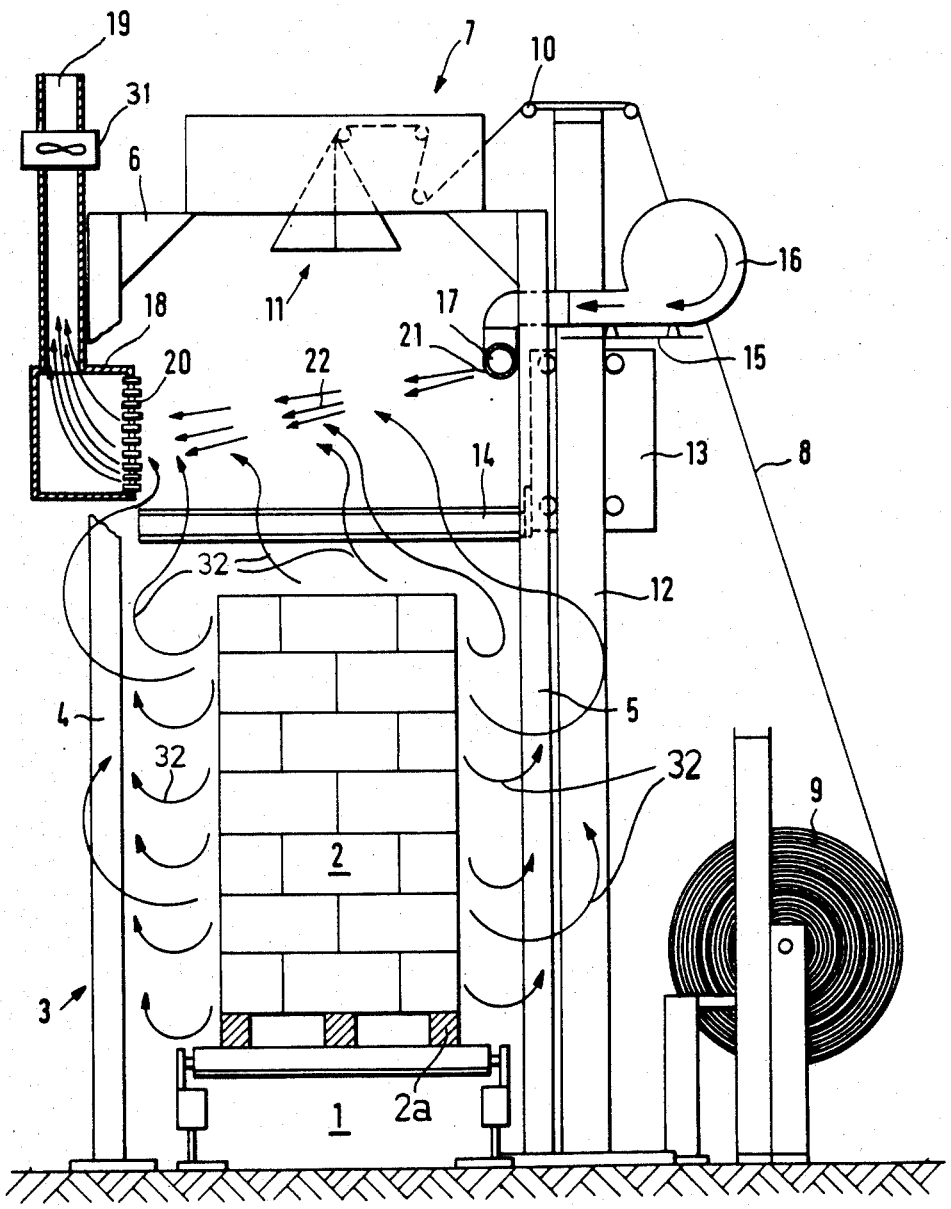
19
31
6
7
10
16
11
18
17
21
15
20
22
13
8
14
32
12
4
5
32
32
9
2
3
2a
1

SHRINK-WRAPPING APPARATUS, ESPECIALLY FOR STACKED ARTICLES

FIELD OF THE INVENTION

My present invention relates to a packaging apparatus, and more particularly to an apparatus for packaging a stack of goods, especially palletized goods, by shrinking a heat shrinkable foil envelope or sheath onto it.

BACKGROUND OF THE INVENTION

A stack of goods can be packaged by heat shrinking a shrinkable foil covering or envelope on the stack of goods on a pallet.

It comprises a delivery mechanism for drawing a tubular thermoplastic synthetic resin foil from a roll of tubing and which cuts away a piece from the foil tubing and simultaneously closes the top of that piece by an upper end weld seam, and a framelike vertically movable shrinking mechanism which heats all sides of the sheath or envelope covering the stack of goods.

A packaging apparatus can automatically provide a stack of goods with such a shrinkable foil covering and shrink that covering onto the stack.

The foil tubing drawn from a roll of tubing is passed over the stack of goods by feeding it through a spreading mechanism. The folded foil tubing is opened by the spreading mechanism as it is put on the stack of goods. During the cutting away of the piece from the foil tubing which serves as the shrinkable foil covering the end weld seam is simultaneously formed so that the top of the foil covering is closed. The foil covering is subsequently shrunk by infrared radiation or heated air.

The framelike shrinking mechanism is movable in a vertical direction over the stack of goods provided with the shrinkable foil covering. After that heat is applied and the foil covering is shrunk.

During the shrinking process the heat is also transferred to the surroundings. The surrounding air is heated and a strong upwards flow of heated air occurs in and around the shrinking mechanism even if the heating unit is an infrared radiation.

The heated air can reach the delivery mechanism for drawing foil tubing from the roll of tubing located above the stack of goods. Thus there is the danger of premature shrinkage of the piece of foil tubing by convection due to the upwardly flowing heated air.

OBJECTS OF THE INVENTION

It is an object of my invention to provide an improved apparatus for shrink packaging a stack of goods which obviates drawbacks of earlier systems.

It is also an object of my invention to provide an improved apparatus for packaging a stack of goods by shrinking a shrinkable foil covering onto the stack in which a premature shrinking of the shrinkable foil covering or the foil tubing is avoided.

SUMMARY OF THE INVENTION

These objects and others which will become more readily apparent hereinafter are attained in accordance with my invention in an apparatus for packaging a stack of goods in a fixed location or on a conveyor which operates by shrinking a shrinkable foil covering on the stack of goods and which comprises a delivery mechanism for drawing a foil tubing from a roll of foil tubing, which cuts away a piece from the foil tubing and closes the top of the piece by an end weld seam, and a framelike vertically movable shrinking mechanism which heats all sides of the piece of the thermoplastic covering the stack of goods.

According to my invention under the delivery mechanism but above the range of motion of the shrinking mechanism a nozzle device for making an air curtain which extends substantially horizontally is provided and a blower for providing the air curtain is connected to the nozzle device.

This air curtain extending generally horizontally through the apparatus and above the stack of goods takes the rising heated air with it and carries it away so that the heat no longer reaches the vicinity of the mechanism for drawing the foil tubing from the provided roll.

The nozzle device is mounted on one side of the apparatus and a hood intake with accompanying exhaust duct is provided on another opposing side of the apparatus. The hood intake and the exhaust duct prevent the air flow of the air curtain and the warm air rising to it from moving uncontrollably into the room. Furthermore an exhaust fan can also be provided in the exhaust duct.

The nozzle device and the associated blower are mounted on a frame on which the shrinking mechanism is guided, thereby providing a compact structure for the apparatus and, moreover, additions of the blower and the nozzle device, to pre-existing equipment.

The nozzle device is a slotted pipe, whose outlet slot directed toward the hood intake has a length at least approximately equal to the corresponding dimension of the shrinking mechanism. Other embodiments of the nozzle device are understandably also possible as long as the air curtain produced by them must extend over the entire breadth of the shrinking mechanism.

BRIEF DESCRIPTION OF THE DRAWING

The above and other objects, features and advantages of my invention will become more readily apparent from the following description, reference being made to the accompanying highly diagrammatic drawing, the sole FIGURE of which is a side elevational view of an apparatus for packaging a stack of goods according to my invention.

SPECIFIC DESCRIPTION

The packaging apparatus shown in the drawing is mounted over a conveyor 1, i.e. a roller conveyor, on which a stack of goods 2 on a pallet 2a moves.

The packaging apparatus covers the stack of goods and pallet with a shrinkable foil covering or envelope which is then shrunk.

This packaging apparatus has a gantrylike frame 3 consisting of the frame posts 4 and 5 and an upper frame cross member 6.

A delivery mechanism 7 for drawing foil tubing 8 from a roll 9 of the tubing is mounted on the upper frame cross member 6. As shown in the drawing, the roll 9 of the foil tubing 8 is guided by a plurality of guide rollers 10 to a spreading mechanism 11 not shown in detail in the drawing. An unshown cutting and welding mechanism is also a part of the spreading mechanism 11, which cuts the foil tubing 8 into lengths provided, simultaneously with cutting, with an end weld seam. The pieces cut away from the foil tubing 8 form a shrinkable foil envelope, which is then drawn over the stack of goods 2.

A carriage 13 is movable up and down on a supporting column 12 positioned next to the frame 3 and carries a shrinking mechanism 14. The shrinking mechanism 14 has the shape of a rectangular frame, whose interior opening is larger than the stack of goods 2, so that the shrinking mechanism 14 surrounding the stack of goods 2 on all sides is movable vertically. The shrinking mechanism 14 can operate with by directing infrared radiation or heated gases onto the shrinkable envelope.

A blower 16 is mounted on a bracket 15 attached to supporting column 12. The blower 16 has a nozzle device 17 connected to it which is found under the upper frame cross member 6 above the uppermost operating position of the shrinking mechanism 14. The nozzle device or slotted pipe 17 extends horizontally from the bracket 16. The pipe 17 is mounted on the post 5. The length of the pipe 17 is at least approximately equal to the corresponding dimension of the shrinking mechanism 14.

On the side of the packaging apparatus opposite the pipe 17 a hood intake 18 is mounted on the frame post 4, from which an exhaust duct 19 extends. The hood intake 18 has a grate 20 in this embodiment and extends substantially parallel to the pipe 17. The pipe 17 and the hood intake 18 have similar lengths. The outlet slot or nozzle 21 of the pipe 17 extends substantially over the entire length of the pipe 17 and is directed toward the hood intake 18.

During operation of the apparatus, i.e. during shrinking, the heated gases rise as indicated by the arrows 32 in the drawing. These heated exhaust gases are entrained by air currents 22 issuing from the outlet slot or nozzle 21 and conducted to the hood intake 18, from which they are conducted away by an exhaust duct 19. The hot gases then no longer reach the vicinity of the upper frame cross member 6 and the delivery mechanism mounted there.

The exhaust duct 19 can also be provided with an exhaust fan 31.

I claim:

1. In an apparatus for packaging a stack of goods by shrinking a shrinkable foil covering on said stack of goods and which comprises a delivery mechanism above the stack for drawing a foil tubing from a roll of said foil tubing, which cuts away a piece from said foil tubing and closes the top of said piece by an end weld seam, and a framelike vertically movable shrinking mechanism which heats all sides of said piece on said stack of goods, the improvement wherein below said delivery mechanism but above a range of travel of said shrinking mechanism, a nozzle device for generating an air curtain extending substantially horizontally across the top of the stack is provided, and a blower for providing said air curtain is connected with said nozzle device.

2. The improvement according to claim 1 wherein said nozzle device is mounted on one side of said apparatus and a hood intake with accompanying exhaust duct is provided on an opposite side of said apparatus across said stack from said nozzle duct.

3. The improvement according to claim 2 wherein said nozzle device and said associated blower are mounted on a frame on which said shrinking mechanism is guided.

4. The improvement according to claim 3 wherein said nozzle device is a slotted pipe with an outlet slot directed toward said hood intake having a length, which is at least approximately equal to the corresponding dimension of said shrinking mechanism.

5. The improvement according to claim 4 wherein an exhaust fan is provided in said exhaust duct.

6. An apparatus for packaging a stack of goods which provides said stack of goods with a shrinkable foil covering and shrinks said shrinkable foil covering comprises:

a gantrylike frame comprising two frame posts and a frame cross member positionable over said stack of goods;

a framelike vertically movable shrinking mechanism mounted on said frame which can heat all sides of said stack of goods;

a delivery mechanism for drawing a foil tubing from a roll of said foil tubing which cuts away a piece from said foil tubing and closes the top of said piece by an end weld seam;

a nozzle device mounted on one side of said apparatus for making an air curtain extending substantially horizontally is provided under said delivery mechanism but above a range of travel of said shrinking mechanism and all across the width thereof;

a blower connected with said nozzle device to provide said air curtain; and a hood intake with accompanying exhaust duct and exhaust fan positioned on an opposite side of said apparatus from said nozzle device.

* * * * *